US006510887B1

(12) United States Patent
Ishihara et al.

(10) Patent No.: US 6,510,887 B1
(45) Date of Patent: Jan. 28, 2003

(54) METHOD FOR PRODUCING CASTED BODY HAVING THIN PORTION

(75) Inventors: Yasuyuki Ishihara, Tokai (JP); Tomoyasu Sumiya, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 134 days.

(21) Appl. No.: 09/595,065

(22) Filed: Jun. 16, 2000

(30) Foreign Application Priority Data

Jun. 18, 1999 (JP) ..... 11-172223
Jun. 13, 2000 (JP) ..... 2000-176951

(51) Int. Cl.[7] ..... B22C 1/00; B22C 9/22
(52) U.S. Cl. ..... 164/6; 164/520; 164/245
(58) Field of Search ..... 164/15, 34, 35, 164/36, 45, 235, 246, 6, 520

(56) References Cited

U.S. PATENT DOCUMENTS 4,068,702 A * 1/1978 Herold ..... 164/30
4,078,598 A * 3/1978 Kelso et al. ..... 164/30
4,549,597 A * 10/1985 Hammamura et al. ..... 164/35
5,303,761 A * 4/1994 Flessner et al. ..... 164/15
5,323,838 A * 6/1994 Hamashima et la. ..... 164/113
5,641,014 A * 6/1997 O'Connor et al. ..... 164/516
5,853,044 A * 12/1998 Wheaton et al. ..... 164/516
6,186,217 B1 * 2/2001 Sikkenga et al. ..... 164/137

* cited by examiner

*Primary Examiner*—M. Alexandra Elve
*Assistant Examiner*—Len Tran
(74) *Attorney, Agent, or Firm*—Burr & Brown

(57) ABSTRACT

A method for producing a cast body having a thin portion is provided, including subjecting a thin member of iron, copper, or nickel alloy to metal-ceramic insertion in a matrix of iron or copper. In the method, the thin member including a ceramic layer on the surface thereof to prevent the thin member from melting upon metal-ceramic insertion. Alternatively, a ceramic layer is formed by using a thin member containing 0.5 wt % or more in total of at least one element selected from the group consisting of Al, Ti, Be and Mg, at least on or near a surface of the thin member, either at the time metal-ceramic insertion or at the time of heating prior to metal-ceramic insertion to prevent the thin portion from melting upon metal-ceramic insertion.

4 Claims, 7 Drawing Sheets

19
1

14
19

2
20
FIRING 11
6

METHOD FOR PRODUCING CASTED BODY HAVING THIN PORTION

BACKGROUND OF THE INVENTION

The present invention relates to a method for producing a cast body having a thin portion, which is used as a mold for molding a tire, a cooling fin in a cylinder block of motor cycle, or the like.

Since a cast body using an iron-group material such as iron and steel has high strength, such cast bodies are used for various purposes, such as molds for molding tires. Incidentally, the term "iron" means an iron-group material containing more than 0.3 wt % of carbon, and the term "steel" means an iron-group material containing 0.3 wt % or lower of carbon. General methods for producing a cast body using iron-group materials such as iron and steel are sand mold casting, the lost wax process, and the Shaw process.

In sand mold casting, as shown in FIGS. 2(*a*) and 2(*b*), molten metal 3 of iron or steel is poured into a mold 2 (FIG. 2(*a*)) made of sand from a prototype 1 and subjected to casting.

In the lost wax process, as shown in FIGS. 3(*a*), 3(*b*), 3(*c*), and 3(*d*), a prototype 1 made of wax is immersed in slurry 4 containing a binder such as ethyl silicate and Substitute Specification refractory fine powder (FIG. 3(*a*)), a sand layer 5 is formed on the outer surface of the prototype 1 (FIG. 3(*b*)), the prototype 1 is heated to let the wax flow out to obtain a mold 2 of sand (FIG. 3(*c*)), and molten metal is poured into the mold 2 for casting (FIG. 3(*d*)).

In the Shaw process, molten metal of iron or steel is poured into a ceramic mold. Specifically, as shown in FIG. 4(*a*), slurry 4 having as main components ethyl silicate and refractory fine powder is poured into a prototype 1 made of rubber or the like to be gelated. Then, the ceramic mold is subjected to primary firing by a direct fire, and then secondary firing in an electric furnace to obtain a mold. Finally, as shown in FIG. 4(*b*), molten metal 3 of iron or steel is poured into the mold 2 for casting. Incidentally, primary firing by a direct fire is for forming fine cracks in the whole mold by rapidly evaporating alcohol contained in the compact. The cracks have the function of improving air-permeability upon casting and suppressing breakage of the mold.

In the Shaw process, a die-rapped compact is immersed in liquid having low viscosity and volatility at room temperature such as methanol, ethanol, and propanol in some cases, and left for 10–40 minutes for a stabilizing treatment. This is to fire the mold after the dimensions of the mold are stabilized by being left for a certain time after it is die-rapped, since the dimensional change during firing is large if the die-rapped compact is immediately fired. The reason why the compact is immersed in liquid such as ethanol in the stabilizing treatment is because the aforementioned cracks are effectively formed upon firing the compact by preventing the compact from the evaporation of alcohol therein.

However, in the above conventional method, the following problems arise for a cast body having a thin portion 6 having a thickness of 2 mm, e.g., a mold 7 for molding a tire having a protrusion 9 corresponding to a sipe (FIG. 5(*a*)), and a cylinder block 8 having a cooling fin for automobile (FIG. 5(*b*)).

First, even if a narrow sipe is formed in the mold, molten metal does not flow down to the bottom of the sipe upon molding, and therefore, formation of a thin portion is difficult.

Even if the thin portion can be formed, the strength properties, such as fracture strength, elongation, and tenacity, are insufficient in some cases depending on thickness of the thin portion. In the case of a mold for molding a tire, the thin portion easily breaks, for example, when rubber adhered to the mold is removed by sandblast.

Further, often in sand mold casting and the Shaw process, a mold is produced using a rubber prototype. However, the protruding portion corresponding to a thin portion is torn off when the mold is removed from the prototype, and thereby the prototype cannot be reused. In other cases, the protruding portion corresponding to a thin portion is deformed when a mold is produced, and therefore it is difficult to produce a mold having high dimensional precision. Further, in the Shaw process, even if a sipe corresponding a thin portion is formed in a compact of a mold, the fire does not reach up to the innermost recess upon primary firing of the compact, and the surface portion of the compact is rapidly heated. As a result, the width of the sipe is partially changed, and therefore molten metal is not carried well through the portion of the sipe having a narrow width. This causes the formation of a pore in the thin portion or unevenness in thickness of the thin portion (defect of insufficient run).

To solve the above problems, a method could be used in which a thin member 10 of iron, steel, or nickel alloy having the same thickness as the thin portion is disposed in a suitable portion of a mold 2 (FIG. 6(*a*)), and the thin member 10 is subjected to metal-ceramic insertion (FIG. 6(*b*)) to form a thin portion 6 in a cast body 11 FIG. 6(*c*)). However, microelements such as C, Si, and Mg are shifted from a matrix 12 to the surface or the vicinity of the surface of the thin member 10, and since this causes the following problems, the method is not practical.

Since the matrix of the cast body has lower melting point than the thin member originally, and the melting point of the thin member descends by shifting of microelements, the thin member melts if molten metal forming the matrix contacts the thin member, and thereby the composition in the vicinity of the thin member is locally shifted by components eluted from the molten thin member. Since the melting point in the portion where the composition is locally shifted descends, the portion is more slowly solidified than the other portion of the matrix. Therefore, replenishment for the shrinkage by the solidification of this portion is not received, and a pore 13 is formed in this portion (local shrinkage cavity).

Further, since components eluted from a molten thin member cause extraordinary curing in the vicinity of the thin member, the corresponding portion of a cast body becomes brittle. Therefore, the cast body is prone to having a low degree of impact load, or machining becomes difficult because of blade damage where machining is required after casting is complete.

The present invention has been made in view of such problems and aims to provide a method for producing a cast body having a thin portion, in which the thin portion has high dimensional precision and can be formed by casting. The present invention also provides a method for producing a cast body having a thin portion which does not create local shrinkage cavities and cause extraordinary curing, even if metal-ceramic insertion is performed, and which produces a thin portion having sufficient strength and high dimensional precision.

SUMMARY OF THE INVENTION

According to the present invention, a method for producing a cast body having a thin portion is provided, including the step of subjecting a thin member formed by one material selected from the group consisting of iron, copper, and nickel alloy, to metal-ceramic insertion in a matrix of iron or copper. The thin member includes a ceramic layer on the surface thereof to prevent the thin member from melting upon being subjected to metal-ceramic insertion.

According to another embodiment of the present invention, a method for producing a cast body having a thin portion is provided, including the step of subjecting a thin member formed by one material selected from the group consisting of iron, copper, and nickel alloy, to metal-ceramic insertion in a matrix of iron or copper, wherein a ceramic layer being formed, by the use of the thin member containing 0.5 wt % or more in total of at least one element selected from the group consisting of Al, Ti, Be and Mg, at least on or near a surface of the thin member at the time metal-ceramic insertion or at the time of heating prior to metal-ceramic insertion to prevent the thin portion from melting upon metal-ceramic insertion.

According to yet another embodiment of the present invention, any of the aforementioned methods for producing a cast body having a thin portion based on the Shaw process can be used, further comprising the steps of preparing a compact for a ceramic mold from a prototype, subjecting the compact to a stabilizing treatment, firing the compact to obtain the ceramic mold, and obtaining a cast body by pouring molten metal of iron or copper in the ceramic mold. The ceramic mold having the thin portion member disposed therein is molded from a metallic piece a prototype having a thin member made of iron or copper in the step of preparing a compact, and a burr generated in the compact is removed in the step of subjecting the compact to a stabilizing treatment.

According to the present invention, there is further provided a method for producing a cast body having a thin portion, comprising the steps of pouring molten metal of iron or copper into a ceramic mold, wherein the ceramic mold is produced by firing a compact having a metallic piece having the same thickness as the thin portion disposed in a portion corresponding to a thin portion, and then removing the metallic piece.

The cast body having a thin portion may be a die for molding a tire, and said thin portion may be a protrusion for forming a sipe.

DETAILED DESCRIPTION OF THE INVENTION

Figures 1A, 1B, 1C, 1D:
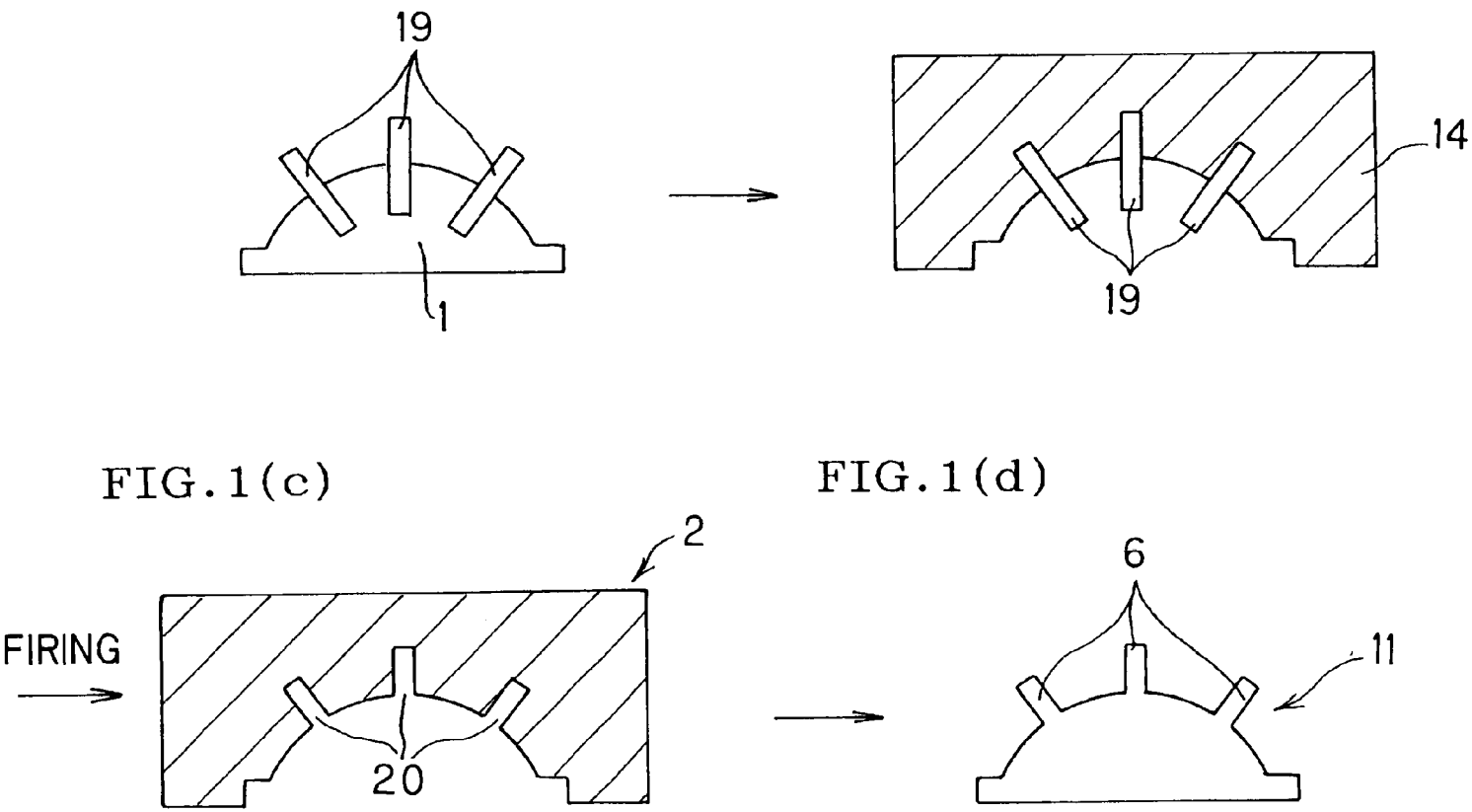
FIGS. 1(*a*)–1(*d*) are sectional step views showing an embodiment of a method for producing a cast body having a thin portion of the present invention.
Figure 2A:
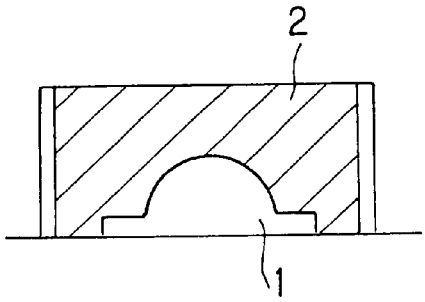
FIGS. 2(*a*) and 2(*b*) are sectional step views showing an embodiment of sand mold casting.
Figure 2B:
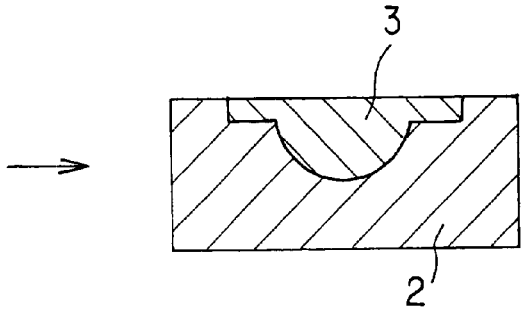
Figure 3A:
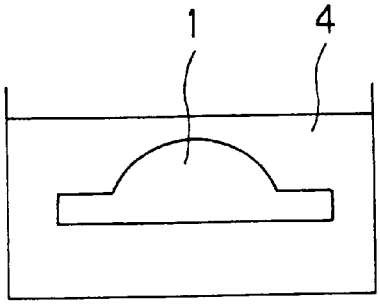
FIGS. 3(*a*)–3(*d*) are sectional step views showing an embodiment of the lost wax process.
Figure 3B:
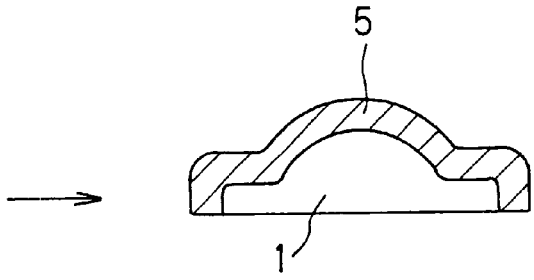
Figure 3C:
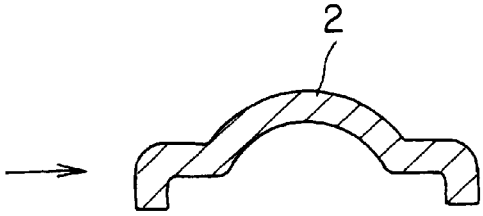
Figure 3D:
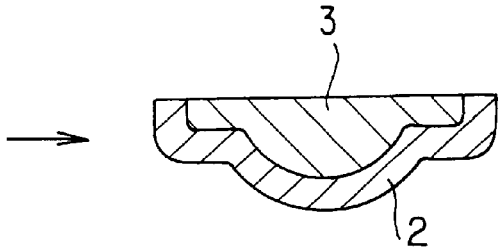
Figure 4A:
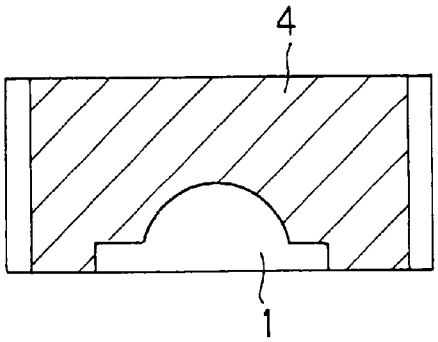
FIGS. 4(*a*) and 4(*b*) are sectional step view showing an embodiment of the Shaw process.
Figure 4B:
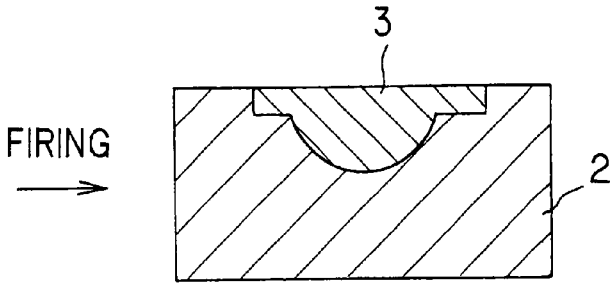
Figure 5A:
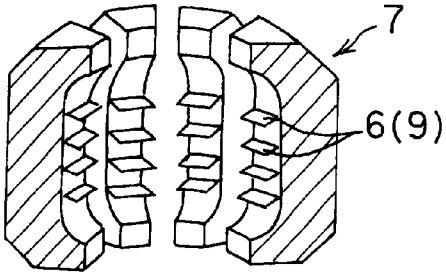
FIG. 5(*a*) is a perspective view of an embodiment of a die for molding a tire, and FIG. 5(*b*) is a perspective view of an embodiment of a cooling fin for a cylinder block of a motor cycle.
Figure 5B:
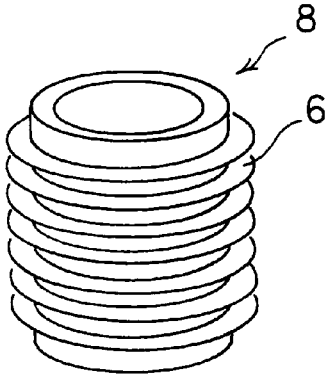
Figure 6C:
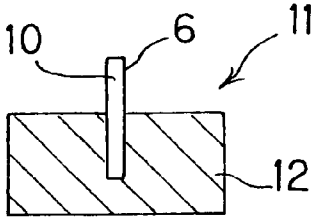
FIGS. 6(*a*)–6(*c*) are sectional step views showing an embodiment of conventional method for producing a cast body having a thin portion.
Figure 6B:
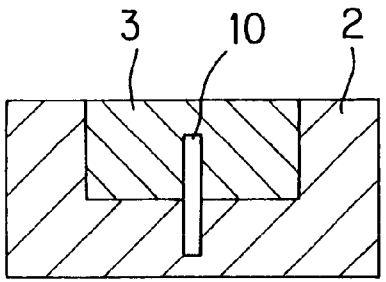
Figure 6A:
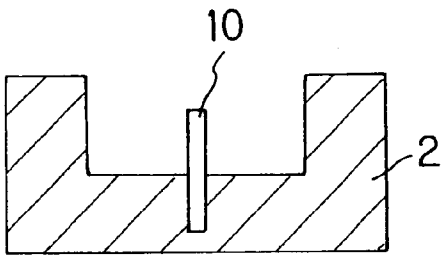
Figure 7:
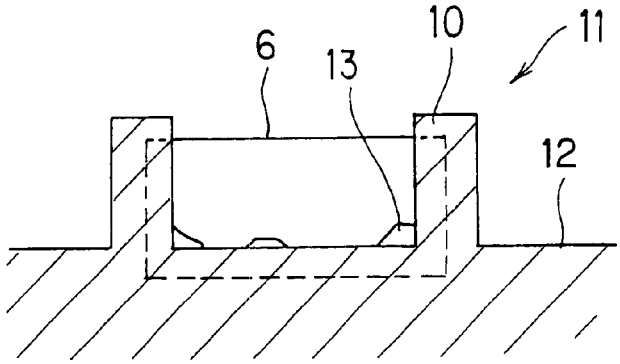
FIG. 7 is a schematic view showing an embodiment of defect of a local shrinkage cavity.

In the present invention, where a cast body having a thin portion is produced by subjecting a thin member of iron, copper, or nickel alloy to metal-ceramic insertion in a matrix of iron or copper, a ceramic layer is formed, by the use of a thin member containing 0.5 wt % or more in total of at least one element selected from the group consisting of Al, Ti, Be and Mg, at least on or near a surface of the thin member either at the time of metal-ceramic insertion or at the time of heating prior to metal-ceramic insertion to prevent the thin portion from melting upon metal-ceramic insertion.

As described above, localized shrinkage cavities and extraordinary curing are caused due to melting of the thin member. The melting of the thin member is caused due to the descent of the melting point of the thin member caused by shifting of microelements in the matrix to the surface, or the vicinity of the surface, of the thin member. Therefore, if the shifting of the microelements to the thin member is impeded, the thin member does not melt, and therefore localized shrinkage cavities and extraordinary curing are impeded. In the present invention, the shifting of the microelements is impeded by using a thin member having a ceramic layer previously formed on its surface, or a thin member having a composition which forms a ceramic layer at least on the surface, or in the vicinity of the surface, of the thin member upon metal-ceramic insertion or heating prior to the metal-ceramic insertion.

Since localized shrinkage cavities and extraordinary curing can be impeded, it becomes possible to subject a thin member of iron, steel, or nickel alloy to metal-ceramic insertion in a matrix of iron or steel. Pursuant to this, a thin portion having a thickness of 0.5–0.2 mm, which has heretofore been difficult to form with high precision and sufficient strength in casting, can be formed with sufficient dimensional precision and sufficient strength. Though the kinds of ceramic material for the ceramic layer are not particularly limited in the present invention, an oxide ceramic, such as $Al_2O_3$, $TiO_2$, and MgO, or a nitride ceramic, such as AlN, may be suitably used. The ceramic layer is preferably dense in view of effectively preventing micro-components from entering.

As a method for forming a ceramic layer on a surface of the thin member, known methods such as CVD, PVD, or spraying micro-powders dispersed in an organic solvent may be employed. However, CVD or PVD is preferably employed in view of securely preventing melt loss, and a spray treatment is preferably employed in view of cost and workability.

In forming a ceramic layer on a thin member upon metal-ceramic insertion or heating prior to metal-ceramic insertion, a thin member having 0.5 wt % or more in total of at least one element selected from the group consisting of Al, Ti, Be and Mg may be used, i.e., a thin member having a composition forming a ceramic layer on the surface, or in the vicinity of the surface of the thin member. By producing a cast body by the use of such a thin member, the thin member is heated at 1250–1400° C. upon metal-ceramic insertion in the sand mold casting to form a ceramic layer on the surface, or in the vicinity of the surface, of the thin member. On the other hand, in the lost wax process and the Shaw process, a thin member is heated at 800–1000° C. upon metal-ceramic insertion, or upon heating prior to metal-ceramic insertion, i.e., upon firing, to form a ceramic layer on the surface or in the vicinity of the surface of the thin member. The reason why 0.5 wt % or more in total of elements such as Al should be contained is because a ceramic layer having a thickness sufficient for preventing microelements from entering cannot be formed if the amount is less than 0.5 wt %.

A method of the present invention where a ceramic layer is formed in a thin member and subjected to metal-ceramic insertion may be applied to not only the lost wax process and the Shaw process, but also other casting methods using iron or steel.

In the case that the aforementioned method where entering of micro-components is hindered by a ceramic layer formed in a thin member is applied to the Shaw process, it is preferable to mold a ceramic die having a thin member disposed therein from a prototype having a thin member of iron, steel, or a nickel alloy disposed in a molding process of the die and to remove burrs generated in a molded body in a stabilization treatment step.

Figure 9A:
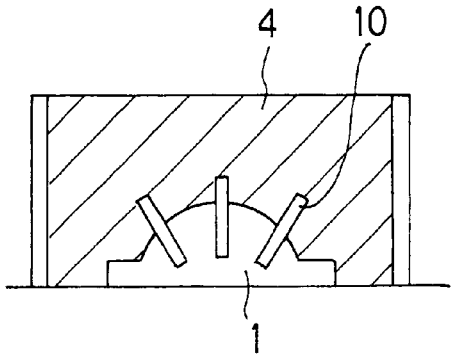
FIGS. 9(*a*) and 9(*b*) are sectional views showing an embodiment of method for disposing a thin member in a ceramic die in a method for producing a cast body having a thin portion of the present invention.
Figure 9B:
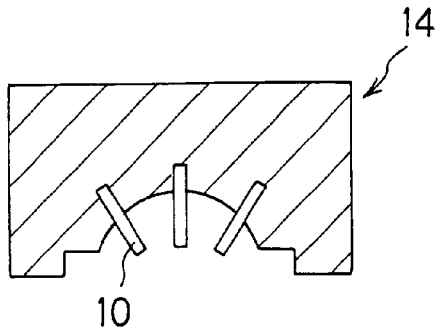
Figure 10A:
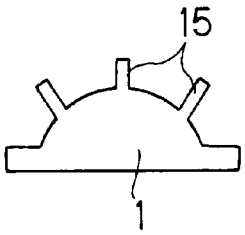
FIGS. 10(*a*) and 10(*b*) are sectional views showing an embodiment of method for disposing a thin member in a ceramic die in a conventional method for producing a cast body having a thin portion, FIG. 10(*c*) is a schematic view showing an example of a thin member which cannot be disposed by a conventional method, and FIG. 10(*d*) is a schematic view showing an embodiment of breakage.
Figure 10B:
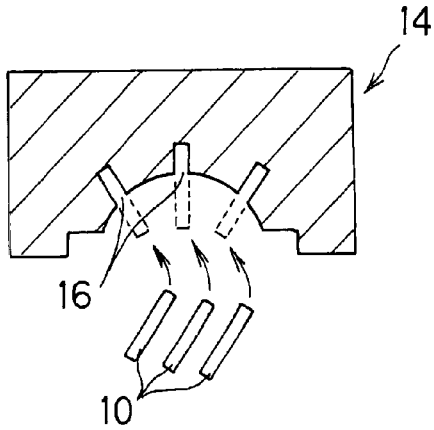
Figure 10C:
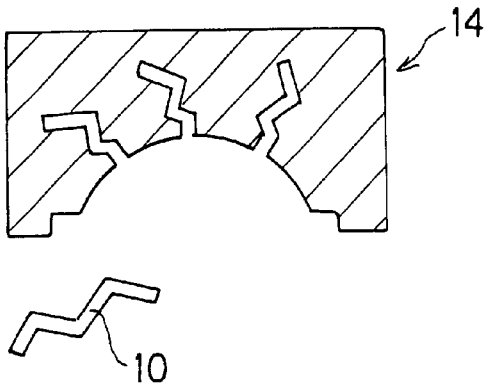
Figure 10D:
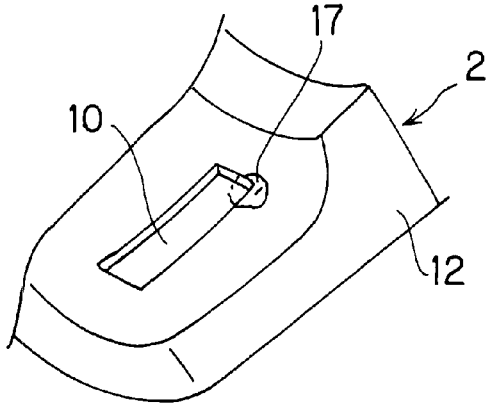

In the molding process, a ceramic die having a thin member therein is molded by a prototype having a thin member of iron, steel, or a nickel alloy, i.e., slurry 4 is poured into a prototype 1 having a thin member 10 (FIG. 9(*a*)), and the thin member 10 is removed from the prototype 1 with a molded body 14 of a die when the die is detached (FIG. 9(*b*)), to mold a ceramic die having a thin member disposed therein. As a method to dispose a thin member in a ceramic die, there may be considered a method where a protrusion 15 corresponding to a thin portion (FIG. 10(*a*)) is provided in a prototype 1 of rubber, or the like, and a thin member 10 is disposed in a groove 16 formed in a molded body 14 for a die produced from the prototype 1. However, it is practically difficult to make the shape and dimensions of the thin member 10 coincide with those of the groove 16 formed in the molded body 14 of a die. Further, depending on the shape of the thin member 10, it is difficult to remove the molded body of a die from the prototype or to dispose the thin member in a groove.

Alternatively, a method where a thin member is disposed after a molded body for a die is fired may be considered. However, in this method, the ceramic die 2 sometimes breaks, as shown in FIG. 10(*d*) by the expansion of the thin member upon casting, due to the difference in thermal expansion properties between the ceramic die and the thin member of iron, steel, or a nickel alloy.

On the other hand, if a ceramic die having a thin member disposed therein is molded using a prototype where the thin member is disposed, such inconveniences can be avoided for the following reason. That is, the molded body for the die with the thin member disposed therein is subjected to a firing treatment at 800–1000° C., and in this firing process, the thin member is expanded by the heat. However, the thermal expansion of the thin member is absorbed by a gap formed by the disappearance of alcohol from the molded body for a die, or vitrification (transformation) and thermosoftening (glass-softening) of a vitreous binder in the molded body for a die. Since the thin member shrinks after being fired, a gap is formed between the thin member and a die. Therefore, the gap can absorb thermal expansion of the thin member during casting, and the ceramic die does not break.

Figure 8:
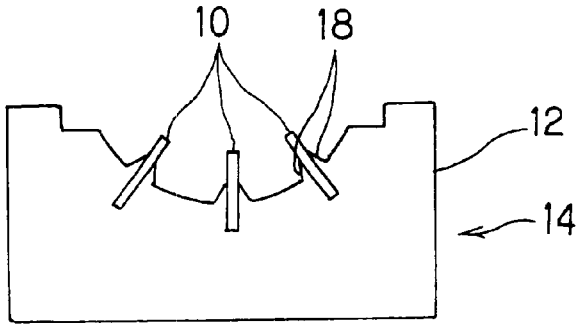
FIG. 8 is a schematic view showing an embodiment of state of burrs.

Further, the reason why burrs generated in the molded body are removed in a stabilization treatment step is because since the ceramic is set after being fired, it is difficult to remove burrs. On the other hand, since the molded body for a die has a rubber elasticity in the stabilization treatment step, it is easy to subject the molded body to working, and it is possible to finish the molded body beautifully. Since the molded body for a die is immersed in a liquid of methanol or the like in the stabilization treatment step, the burrs are removed while the molded body for a die is immersed in the liquid. The burrs 18 are generated mainly in both sides of the thin member due to a gap between a prototype and a thin member disposed in the prototype as shown in FIG. 8.

Further, in the case that a casting having a thin portion is produced by pouring molten metal of iron or steel into a ceramic die in the present invention, a ceramic die 2 (FIG. 1(*c*)) is produced by firing a molded body 14 for a die (FIG. 1(*b*)) having a metallic piece 19 having the same thickness as a thin portion in a position corresponding to the thin portion, and then removing the metallic piece 19 as shown in FIGS. 1(*a*)–1(*d*).

Since the width of groove 20 is not partially changed even if a surface portion of the molded body for a die is rapidly heated by disposing a metallic piece 19 having the same thickness as a thin portion during heating, conventional inconveniences of formation of pores in a thin portion of a cast body and unevenness in thickness of a thin portion can be avoided. Therefore, a cast body 11 (FIG. 1(*d*)) having a thin portion 6 having high precision can be produced. This method can be suitably applied to a casting method where casting is conducted using a ceramic die as well as the Shaw process.

In this case, if the metallic piece 19 is disposed in a molded body 14 for a die by disposing the metallic piece 19 in a prototype in the step of the rubber prototype 1 as shown in FIG. 1(*a*) and extracting the metallic piece 19 from the prototype 1 with the molded body 14 for a die (FIG. 1(*b*)), the groove 20 corresponding to a thin portion having a complex shape which is hardly formed with rubber or the like can be accurately formed in the die 2. In this case, burrs are generated on both sides of the metallic piece 19 due to a gap between the prototype 1 and the metallic piece 19 disposed in the prototype 1. In the Shaw process, burrs are preferably removed in a stabilization treatment step in view of workability and precision in design of a cast body.

In this method, casting is conducted by casting a rib to the end. Therefore, in the case that the thickness of the thin portion is too small, the thin portion sometimes has insufficient strength, or the thin portion obtains a poor shape because molten metal extends over the whole grave of a die. Therefore, the method is not very suitable for forming a thin portion having a thickness of 0–0.5 mm.

As described above, a thin portion having sufficient strength and high dimensional precision can be formed according to the present invention. Therefore, the method of the present invention can be suitably used for the whole range of production of a cast body having thin portion, for example, a die for molding a tire, a cooling fin in a cylinder block of a motorcycle or the like, a heat sink, and a motor housing.

The present invention is described in more detail on the basis of Examples. However, the present invention is by no means limited to these Examples.

EXAMPLE 1

Figure 11A:
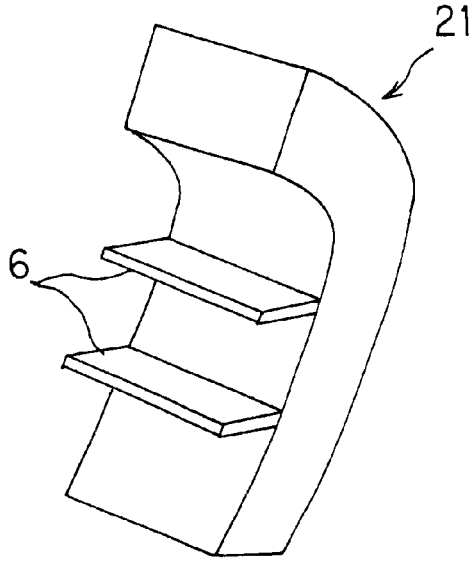
FIG. 11(*a*) is a schematic view showing another embodiment of a die for molding a tire, and FIG. 11(*b*) is a schematic view showing still another embodiment.
Figure 11B:
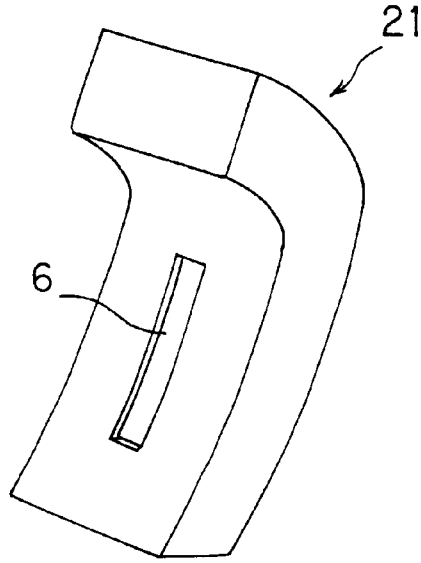

A disintegrated die 21 for molding an automobile tire having a thin portion 6 provided in a direction of the circumference as shown in FIG. 11(*a*) was produced in the Shaw process by subjecting a thin member having a ceramic layer formed previously on a surface thereof to metal-ceramic insertion.

Figure 12A:
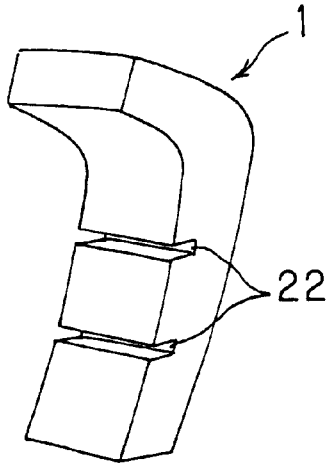
FIGS. 12(*a*) and 12(*b*) are step views showing an embodiment of a method for disposing a thin member in a prototype in a method for producing a cast body having a thin portion of the present invention.
Figure 12B:
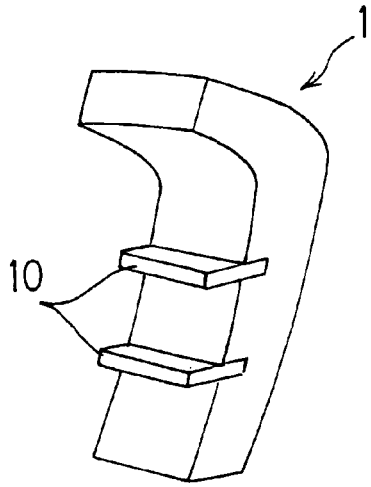

First, a rubber prototype 1 having a groove 22 for disposing a thin member (FIG. 12(*a*)) was produced by the use of condensed silicone rubber. A thin member 10 having a ceramic layer formed previously on a surface thereof was disposed in the groove 22 (FIG. 12(*b*)). The ceramic layer was formed by forming an alumina layer having a thickness of 15–30 μm with a ceramic particle coating agent (Trade name: Ceracoat Spray, produced by Kabushiki Kaisha ODEC) on a thin member of SUS304 (32 mm in length, 19 mm in width, and 0.5 mm in thickness). Table 2 shows composition of SUS304.

Next, a molded body for a die was produced from the above prototype 1. The slurry used here was prepared by kneading ceramic refractory particles with ethyl silicate binder. The molded body for a die was removed from the prototype, and then immersed in industrial alcohol for 20 minutes for a stabilization treatment. During this stabilization treatment, burrs generated in the vicinity of the thin member of the molded body for a die were removed. Soon after the stabilization treatment was completed, the molded compact for a die was subjected to primary firing for 2 minutes by a propane gas burner. Then, the molded compact for a die was subjected to secondary firing for 4 hours at 800° C. in an electric furnace.

Finally, casting was conducted by the use of the aforementioned die to produce 10 disintegrated dies for molding an automobile tire. FCD600 (C: 3.5 wt %, Si: 2.3 wt %: Mn: 0.15 wt %, Fe: the rest) was used as an alloy for casting. The temperature for casting was 1280° C.

The presence of breakage of the die was investigated, and the occurrence of localized shrinkage cavities, and extraordinary curing in the obtained cast body (disintegrated die for molding an automobile tire) and the influence of the removal of burrs on the cast body were investigated by the following methods. The results are shown in Table 1.

Occurrence of Burrs

The presence/absence of breakage was judged by observing the thin member and its vicinity of the die by naked eyes.

Occurrence of Localized Shrinkage Cavities

The vicinity of the metal-ceramic insertion portion of the cast portion was observed by naked eyes to judge the presence/absence of a localized shrinkage cavity.

Occurrence of Extraordinary Curing

The thin member and the vicinity of the metal-ceramic insertion portion of the cast body were measured for hardness and compared to judge. The hardness was measured using a micro Vickers method.

Influence of Removal of Burrs

The state of the surface in the vicinity of the metal-ceramic insertion portion of the cast body was observed by naked eyes to judge using the following criteria:

If a trace after a burr was removed was distinguishable . . . Fail; and

If a trace after a burr was removed was indistinguishable . . . Good.

EXAMPLE 2

The same disintegrated die for molding an automobile tire as in Example 1 was produced in the same manner as in Example 1 as shown in FIG. 11(*b*), except that a thin portion was disposed radially.

The occurrence of breakage in the die during casting was investigated, and the occurrence of localized shrinkage cavities, extraordinary curing, and the influence of removal of burrs were investigated as in Example 1. The results are shown in Table 1.

EXAMPLES 3–5

The same disintegrated die for molding an automobile tire as in Example 1 was produced except that a thin member having a composition forming a ceramic layer (alumina layer in Examples 3 and 5 and titania layer in Example 4) by being heated without using a thin member having a ceramic layer on the surface thereof was used. For the thin members, SUS631 was used in Example 3, MAS1C was used in Example 4, and inconel 718 was used in Example 5. Table 2 shows the compositions of SUS631, MAS1C and inconel 718.

The occurrence of breakage of the die during casting was investigated, and the occurrence of localized shrinkage cavities, extraordinary curing, and the influence of the removal of burrs were investigated as in Example 1. The results are shown in Table 1.

EXAMPLE 6

A molded body for a die having a metallic piece having the same thickness as a thin portion provided in a portion corresponding to the thin portion was fired without subjecting a thin member to metal-ceramic insertion, and then the metallic piece was removed to obtain a die. Using the die, a disintegrated die for molding an automobile tire having a thin portion was produced.

First, a rubber prototype having a groove for disposing a metallic piece was provided. A metallic piece 19 of SUS304 was disposed in this groove. The rubber was the same as in Example 1. The metallic piece had dimensions of 32 mm×19 mm×0.5 mm.

Then, a molded body for a die was produced from the above prototype The same slurry as in Example 1 was used. When the molded body for a die was removed from the prototype, the metallic piece was extracted with the molded body from the prototype to retain the metallic piece in the molded body for a die. The molded body for a die was removed from the prototype and then immersed in industrial alcohol for 20 minutes for a stabilization treatment. During the stabilization treatment, burrs generated around the metallic piece in the molded body for a die were removed. After the stabilization treatment was completed, primary firing and secondary firing were conducted as in Example 1, and the metallic piece was removed to obtain a die.

Finally, casting was conducted by the use of the aforementioned die to produce 10 disintegrated dies for molding an automobile tire. FCD600 was used as an alloy for casting, and the temperature for casting was 1280° C.

The presence/absence of defects of insufficient spread of molten metal on the obtained cast body (disintegrated die for molding an automobile tire) was investigated by naked eyes. The results are shown in Table 1.

Comparative Example 1

A disintegrated die for molding an automobile tire having a thin portion was produced in the same manner as in Example 1, except that a ceramic layer was not formed on the surface of the thin member. The presence of breakage of the die was investigated, and the occurrence of localized shrinkage cavities, extraordinary curing in the obtained cast body (disintegrated die for molding an automobile tire), and the influence of removal of burrs on the cast body were investigated by the following methods. The results are shown in Table 1.

Comparative Example 2

A disintegrated die for molding an automobile tire having a thin portion was produced in the same manner as in Example 1 except that the removal of burrs was performed after the molded body for a die was fired. The presence of breakage of the die was investigated, and the occurrence of localized shrinkage cavities, extraordinary curing in the obtained cast body (disintegrated die for molding an automobile tire), and the influence of the removal of burrs on the cast body were investigated by the following methods. The results are shown in Table 1.

Comparative Example 3

A disintegrated die for molding an automobile tire having a thin portion was produced in the same manner as in Example 1, except that a protrusion corresponding to the thin portion was provided on the prototype, the molded body for a die obtained from this prototype was fired, and casting was performed by the use of a die produced by disposing a thin member in a groove formed by the above protrusion.

The presence of breakage of the die was investigated, and the occurrence of localized shrinkage cavities, extraordinary curing in the obtained cast body (disintegrated die for molding an automobile tire), and the influence of the removal of burrs on the cast body were investigated by the following methods. The results are shown in Table 1.

Comparative Example 4

A disintegrated die for molding an automobile tire having a thin portion provided by casting was produced in the same manner as in Example 6, except that a protrusion corresponding to the thin portion is provided on the prototype without using a metal piece and casting was performed using a die obtained from this prototype.

The presence/absence of defects of insufficient spread of molten metal on the obtained cast body (disintegrated die for molding an automobile tire) was investigated by naked eyes. The results are shown in Table 1.

TABLE 2

| | Composition (wt %) | | | | | | | | | |
|---|---|---|---|---|---|---|---|---|---|---|
| Name of alloy | C | Si | Mn | Ni | Cr | Al | Ti | Mo | Co | Fe |
| SUS304 | ≦0.08 | ≦1.00 | ≦2.00 | 8.0–10.5 | 18.0–20.0 | — | — | — | — | the rest |
| SUS631 | ≦0.09 | ≦1.00 | ≦1.00 | 6.5–7.5 | 16.0–18.0 | 0.75–1.50 | — | — | — | the rest |
| MAS1C | ≦0.03 | ≦0.10 | ≦0.10 | 18.5 | — | 0.10 | 0.60 | 4.80 | 9.00 | the rest |
| Inconel 718 | ≦0.03 | ≦0.10 | ≦0.10 | 54.0 | 18.0 | 0.50 | 0.90 | 3.00 | 9.00 | the rest |

TABLE 1

| | | | | | | Hardness (Hv.) | | Surface condition | | Defect of insufficient |
|---|---|---|---|---|---|---|---|---|---|---|
| | Ceramic layer | Time of removal of burrs | Time of setting thin member | Metallic piece at firing | Occurrence of local shrinkage cavity | Thin member | Matrix around thin member | around metal-ceramic insertion portion | Breakage of die upon casting | spread of molten (Number/10 pieces) |
| Example 1 | Present: alumina layer | In stabilization treatment | before firing | — | None | 180–200 | 300–350 | Good | None | — |
| Example 2 | Present: alumina layer | In stabilization treatment | before firing | — | None | 180–200 | 300–350 | Good | None | — |
| Example 3 | Present: alumina layer | In stabilization treatment | before firing | — | None | 300–350 | 300–350 | Good | None | — |
| Example 4 | Present: titania layer | In stabilization treatment | before firing | — | None | 400–450 | 300–350 | Good | None | — |
| Example 5 | Present: alumina layer | In stabilization treatment | before firing | — | None | 450–500 | 300–350 | Good | None | — |

TABLE 1-continued

| | Ceramic layer | Time of removal of burrs | Time of setting thin member | Metallic piece at firing | Occurrence of local shrinkage cavity | Hardness (Hv.) Thin member | Hardness (Hv.) Matrix around thin member | Surface condition around metal-ceramic insertion portion | Breakage of die upon casting | Defect of insufficient spread of molten (Number/10 pieces) |
|---|---|---|---|---|---|---|---|---|---|---|
| Example 6 | — | In stabilization treatment | — | Present | — | — | — | — | — | 1 |
| Comp. Ex. 1 | None | In stabilization treatment | before firing | — | Present | 180–200 | 650–700 | Good | None | — |
| Comp. Ex. 2 | Present: alumina layer | After firing | before firing | | None | 180–200 | 300–350 | Poor | None | — |
| Comp. Ex. 3 | Present: alumina layer | — | after firing | — | None | 180–200 | 300–350 | — | Present | — |
| Comp. Ex. 4 | — | — | — | None | — | — | — | — | — | 4 |

Table 1 shows that localized shrinkage cavities and extraordinary curing occurred in Comparative Example 1, in which a ceramic layer was not formed in a thin member, while neither localized shrinkage cavities nor extraordinary curing occurred in Examples 1–5, in which a ceramic layer was formed in a thin member. Further, though surface conditions near the metal-ceramic insertion portion of a cast body were good in Examples 1–5, where removal of burrs was conducted during a stabilization treatment, numerous steps were required for finishing in the corresponding portion because of the surface conditions in Comparative Example 2, where burrs were removed after a molded body for a die is fired.

Further, the breakage of a die occurred during casting in Comparative Example 3, where a thin member was disposed after the molded body for a die was fired, while breakage of a die during casting was not found in Examples 1–5, where a thin member was disposed before a molded body for a die was fired.

Further, defects of insufficient spread of molten metal were caused frequently in Comparative Example 4, where a mold body for a die was fired without disposing a metallic piece, while the occurrence of defects of insufficient spread of molten metal in Example 6 occurred far less frequently, where a molded body for a die was fired in the state that a metallic piece was disposed. Further, the variance in thickness of a thin portion was ±0.15 mm in Comparative Example 4 while that was 0.02 mm or less in Example 6.

Since localized shrinkage defects and extraordinary curing can be avoided when a thin member is subjected to metal-ceramic insertion in method for producing a cast body of the present invention, a thin member of iron, steel, or a nickel alloy can subjected to metal-ceramic insertion in a matrix of iron or steel, which has heretofore been conventionally impossible. Further, with this, a thin portion having a thickness of 0.5–0.2 mm can be formed with sufficient dimensional precision and sufficient strength, which has been impossible to be formed since it is difficult to form with precision and strength is insufficient by casting.

Further, since the inconvenience of forming pores in a thin portion of a cast body, or unevenness in thickness of a thin portion, can be avoided in a case that a thin portion is formed by casting, a cast body having a thin portion having high dimensional precision can be produced by casting.

Therefore, the method for producing a cast body of the present invention can be suitably used for the whole range of production of a cast body having thin portion, for example, a die for molding a tire, a cooling fin in a cylinder block of a motorcycle or the like, a heat sink, and a motor housing.

What is claimed is:

1. A method for producing a cast body having a thin portion, comprising the steps of:

providing a mold having an inner molding surface with at least one thin member extending from said inner molding surface, said thin member comprising at least one material selected from the group consisting of iron, copper and nickel alloy, and additionally containing at least 0.5 wt. % of at least one material selected from the group consisting of Al, Ti, Be, and Mg;

forming a ceramic layer at least on or near an entire outer surface of said thin member; and pouring molten iron or copper into said mold to form said cast body;

wherein said ceramic layer is formed by heating before or during said pouring step, and said ceramic layer prevents said thin member from melting upon contact with the molten iron or copper.

2. The method for producing a cast body having a thin portion according to claim 1, further comprising the steps of:

preparing a compact for a ceramic mold from a prototype;

subjecting said compact to a stabilizing treatment;

firing said compact to obtain said ceramic mold; and pouring molten metal of iron or copper in said ceramic mold to form a cast body;

wherein said ceramic mold having said thin portion member disposed therein is molded from a metallic piece prototype having a thin member made of iron or copper in said preparing step, and a burr generated in said compact is removed during said stabilizing treatment.

3. The method for producing a cast body having a thin portion according to claim 1, wherein said cast body having a thin portion is a die for molding a tire, and said thin portion is a protrusion for forming a sipe.

4. The method for producing a cast body having a thin portion according to claim 2, wherein said cast body having a thin portion is a die for molding a tire, and said thin portion is a protrusion for forming a sipe.

* * * * *